US011384565B2

(12) United States Patent
Kuenzi et al.

(10) Patent No.: US 11,384,565 B2
(45) Date of Patent: Jul. 12, 2022

(54) SYSTEM AND METHOD FOR MONITORING AN ACCESS KEY FROM A KEY BOX

(71) Applicant: Carrier Corporation, Palm Beach Gardens, FL (US)

(72) Inventors: Adam Kuenzi, Silverton, OR (US); Pirammanayagam Nallaperumal, Telangana (IN); Neeraja Kanteti, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/063,301

(22) Filed: Oct. 5, 2020

(65) Prior Publication Data

US 2021/0047864 A1 Feb. 18, 2021

Related U.S. Application Data

(63) Continuation-in-part of application No. PCT/US2019/054786, filed on Oct. 4, 2019, and a (Continued)

(30) Foreign Application Priority Data

Mar. 26, 2018 (IN) ..... 201811011031
Oct. 18, 2018 (IN) ..... 201811039483

(51) Int. Cl.
*G07C 9/00* (2020.01)
*G07C 9/28* (2020.01)
(Continued)

(52) U.S. Cl.
CPC ..... *E05B 47/00* (2013.01); *E05B 19/0005* (2013.01); *G07C 9/00571* (2013.01);
(Continued)

(58) Field of Classification Search
CPC ..... G07C 9/00571; G07C 9/27
See application file for complete search history.

(56) References Cited

U.S. PATENT DOCUMENTS 7,061,367 B2 6/2006 Mosgrove et al.
7,336,181 B2 2/2008 Nowak et al.
(Continued)

FOREIGN PATENT DOCUMENTS

CN 203290347 U 11/2013
CN 102521904 B 12/2013
(Continued)

OTHER PUBLICATIONS

English Translation of CN106154214A.
(Continued)

*Primary Examiner* — Daniell L Negron
(74) *Attorney, Agent, or Firm* — Cantor Colburn LLP

(57) ABSTRACT

Disclosed is a system for monitoring a location of a key relative to a keybox, configured to perform: (i) providing access to the key by: communicating over a personal area network with a first mobile-device for the first user as the first user approaches the keybox in an attempt to obtain the key, obtaining first credentials from the first mobile-device, determining whether the first credentials are valid or invalid, when the first credentials are valid: putting the keybox in an unlocked configuration, (ii) tracking a location of the key by: communicating over the personal area network with: the key and/or mobile-device to determine whether the key is being returned to the keybox, wherein upon a determination by the keybox or the mobile-device that the key is not being returned, an alert is provided by the mobile-device to the first user.

12 Claims, 6 Drawing Sheets

Related U.S. Application Data continuation-in-part of application No. 16/146,245, filed on Sep. 28, 2018, now Pat. No. 10,796,519.

(51) Int. Cl.

| | |
|---|---|
| ***G07C 9/27*** | (2020.01) |
| ***E05B 19/00*** | (2006.01) |
| ***E05B 47/00*** | (2006.01) |

(52) U.S. Cl.

CPC ..... *G07C 9/00896* (2013.01); *G07C 9/27* (2020.01); *E05B 2047/0067* (2013.01); *E05B 2047/0095* (2013.01); *E05B 2047/0096* (2013.01); *G07C 2009/00936* (2013.01)

(56) References Cited

U.S. PATENT DOCUMENTS

| | | | | |
|---|---|---|---|---|
| 7,366,522 | B2 | 4/2008 | Thomas | |
| 8,188,837 | B2 | 5/2012 | Patenaude et al. | |
| 8,451,088 | B2 | 5/2013 | Fisher | |
| 8,624,727 | B2 | 1/2014 | Saigh et al. | |
| 8,643,510 | B2 | 2/2014 | Schrabler et al. | |
| 8,798,593 | B2 | 8/2014 | Haney | |
| 8,831,632 | B2 | 9/2014 | Laws et al. | |
| 9,196,139 | B2 | 11/2015 | Gutierrez et al. | |
| 9,333,945 | B2 | 3/2016 | Lin | |
| 9,330,541 | B1 | 5/2016 | Ortiz | |
| 9,355,551 | B2 | 5/2016 | Nixon | |
| 9,357,348 | B2 * | 5/2016 | Evans | H04W 4/023 |
| 9,460,480 | B2 | 10/2016 | Woodard et al. | |
| 9,478,083 | B2 | 10/2016 | Fisher | |
| 9,704,319 | B2 | 7/2017 | Desinor, Jr. | |
| 9,715,815 | B2 | 7/2017 | Verma | |
| 9,743,375 | B2 | 8/2017 | Anesi et al. | |
| 9,854,385 | B2 | 12/2017 | Oliver et al. | |
| 10,102,749 | B1 | 10/2018 | Wagner | |
| 10,219,107 | B2 * | 2/2019 | Lev que | H04W 4/02 |
| 10,403,069 | B2 | 9/2019 | Desinor, Jr. | |
| 10,745,943 | B1 | 8/2020 | Jonak et al. | |
| 2007/0090921 | A1 | 4/2007 | Fisher | |
| 2007/0260883 | A1 | 11/2007 | Giobbi et al. | |
| 2008/0094208 | A1 | 4/2008 | Schwartz | |
| 2011/0159917 | A1 | 6/2011 | Johnson | |
| 2012/0303743 | A1 | 11/2012 | Stonefield et al. | |
| 2013/0117176 | A1 | 5/2013 | Oler | |
| 2014/0062700 | A1 | 3/2014 | Heine et al. | |
| 2014/0132412 | A1 | 5/2014 | Deco et al. | |
| 2014/0213301 | A1 | 7/2014 | Evans et al. | |
| 2015/0109116 | A1 | 4/2015 | Grimm et al. | |
| 2015/0302416 | A1 | 10/2015 | Decelles et al. | |
| 2016/0105766 | A1 | 4/2016 | De La Broise | |
| 2016/0227377 | A1 | 8/2016 | Kuenzi et al. | |
| 2017/0024800 | A1 | 1/2017 | Shah | |
| 2017/0241165 | A1 | 8/2017 | McGinn et al. | |
| 2018/0190056 | A1 | 7/2018 | Desinor, Jr. | |
| 2019/0295355 | A1 | 9/2019 | Santhosh et al. | |
| 2021/0090378 | A1 | 3/2021 | Kuenzi et al. | |
| 2021/0258088 | A1 | 8/2021 | Kanteti et al. | |

FOREIGN PATENT DOCUMENTS

| | | | |
|---|---|---|---|
| CN | 203391730 | U | 1/2014 |
| CN | 203894833 | U | 10/2014 |
| CN | 102852390 | B | 8/2015 |
| CN | 105957215 | A | 9/2016 |
| CN | 106154214 | A | 11/2016 |
| CN | 104346946 | B | 9/2017 |
| CN | 105735826 | B | 12/2017 |
| DE | 102011053242 | A1 | 3/2013 |
| EP | 3107072 | A1 | 12/2016 |
| EP | 3647128 | A1 | 5/2020 |
| WO | 2007128011 | A1 | 11/2007 |
| WO | 2014003717 | A1 | 1/2014 |
| WO | 2017183690 | A1 | 10/2017 |
| WO | 2020081265 | A1 | 4/2020 |

OTHER PUBLICATIONS

Beacon Bluetooth Low Energy BLE 4.0 Reminder Tracker Anti Theft Lost Alarm Locator Bluetooth Beacon; Retrieved on Feb. 6, 2018. Retrieved from the internet;URL: http://https://axaet.en.alibaba.com/product/60324553668-220961191/Beacon_Bluetooth_Low_Energy_BLE_4_0_Reminder_Tracker_Anti_Theft_Lost_alarm_locator_bluetooth_beacon.html; 12 pages.

International Search Report and Written Opinion; Application No. PCT/US2019/054786; dated Dec. 19, 2019; 14 pages.

Magid, L. "Use Your Phone to Find Your Keys and Vice Versa", Forbes, May 3, 2012, Retrieved Aug. 30, 2018 from https://www.forbes.com/sites/larrymagid/2012/05/03/useyourphonetofindyourkeysandviceversa/#2ec98ad717f1, 4 Pages.

* cited by examiner

SYSTEM AND METHOD FOR MONITORING AN ACCESS KEY FROM A KEY BOX

CROSS REFERENCE TO RELATED APPLICATIONS

This application is a Continuation-in-Part of U.S. application Ser. No. 16/146,245, filed Sep. 28, 2018, which claims the benefit of an earlier filing date from Indian Provisional Application Serial No. 201811011031 filed Mar. 26, 2018, and a Continuation-in-Part of International Application No. PCT/US2019/054786, filed Oct. 4, 2019, which claims the benefit of an earlier filing date from Indian Provisional Application Serial No. 201811039483 filed Oct. 18, 2018, the entire disclosures of each prior application are incorporated herein by reference.

BACKGROUND

The disclosed embodiments relate to key tracking and more specifically to monitoring an access from a keybox.

A real estate agent may show an available property to a potential buyer by opening a lock box or a key container, removing an access key chain or an access key card, and accessing the available property. The access key may be small and the agent may forget to replace the access keys in the keybox, or the access key may become misplaced before leaving the property.

BRIEF DESCRIPTION

Disclosed is a system for monitoring a location of an access key relative to a keybox, the keybox including an electronic controller, wherein the controller is configured to perform steps comprising: a first step of providing access to the key within the keybox while the keybox is in a locked configuration, the first step including: communicating over a personal area network with a first mobile-device for the first user as the first user approaches the keybox in an attempt to obtain the key, obtaining first credentials from the first mobile-device, determining whether the first credentials are valid or invalid, when the first credentials are valid: putting the keybox in an unlocked configuration, a second step of tracking a location of the key to determine whether the key is being returned to the keybox, the second step including: communicating over the personal area network with: the key and/or mobile-device to determine whether the key is being returned to the keybox, wherein upon a determination by the key box or the mobile-device that the key is not being returned, an alert is provided by the mobile-device to the first user.

In addition to one or more of the above features and steps, or as an alternative, in the first step: when the first credentials are valid the controller performs the step of securing the keybox in the unlocked configuration, and the second step comprises tracking a proximate location of the key and further comprises: communicating over the personal area network with the first mobile-device as the first user approaches the keybox in an attempt to replace the key, wherein when communicating with the first mobile-device, the second step includes: transmitting first instructions the first mobile-device to query the first user whether the key is being returned to the keybox, and receiving from mobile-device a response to the query, determining whether the response obtained in the second process indicates that the key is being returned to the keybox, and when the response indicates the key is not being returned to the keybox: instructing the mobile-device to provide a first alert to the first user, and when the response indicates the key is being returned to the keybox the controller performs the step of releasing the keybox from the unlocked configuration, so that the keybox may be locked by the first user.

In addition to one or more of the above features and steps, or as an alternative, the controller performs a third step of tracking a distal location of the key relative to the keybox, the third step including: communicating with mobile-device after the first process; determining a travel distance from the keybox to the mobile-device; comparing the travel distance to a threshold distance; determining if the travel distance is greater than the threshold distance, wherein when the travel distance is greater than the threshold distance: instructing the mobile-device to provide a second alert to the first user.

In addition to one or more of the above features and steps, or as an alternative, the first step includes recording in a first data-log a first log entry indicative of the first user being provided with access to the key, the second step includes recording in the data-log a second log entry indicative of the response to the query from the first user, and transmitting to the mobile-device the data-log, for transferring the data-log over to a central server.

In addition to one or more of the above features and steps, or as an alternative, the controller performs a fourth step of tracking a duration the keybox is opened to identify a potentially a misplaced key, the fourth step including: tracking a time that the key is removed from the keybox after the first step, comparing the tracked time against a threshold time, wherein when the tracked time is greater than the threshold time: recording in the first data-log a third log entry indicative of the first user being having the key for a time greater than the threshold time, communicating over the personal area network with a second mobile-device for a second user as the second user approaches the keybox in an attempt to obtain the key, obtaining second credentials from the second mobile-device, determining whether the second credentials are valid, transmitting to the second mobile-device the data-log, for transferring the data-log over the cellular network to the central server.

In addition to one or more of the above features and steps, or as an alternative, the personal area network applies Bluetooth Low Energy protocols and/or radio frequency identification protocols.

In addition to one or more of the above features and steps, or as an alternative, the mobile-device is a mobile phone and in the second process the mobile phone transfers the data-log to the central server over a cellular network.

In addition to one or more of the above features and steps, or as an alternative, in the first step, responsive to receiving the first instructions, the mobile phone presents on a screen for the mobile phone (i) a query of whether the first user is returning the key to the keybox, and (ii) a plurality of engagable radial buttons to receive as input from the first user an indication of whether or not the key is being replaced in the keybox.

In addition to one or more of the above features and steps, or as an alternative, in the first step the first alert is one or more of a first email, a first Short Message Service text, a first audio alert, a first video alert and a first vibratory alert.

In addition to one or more of the above features and steps, or as an alternative, in the third step the second alert is one or more of a second email, a second Short Message Service text, a second audio alert, a second video alert and a second vibratory alert.

Further disclosed is a method for monitoring a location of an access key relative to a keybox, including one or more of the above features and or steps.

Further disclosed is a system for monitoring a location of an access key relative to a keybox, wherein the keybox includes a controller that transmits over a personal area network periodic advertisements of whether the key is in the keybox, the system including a mobile-device configured to perform steps comprising: a first step of monitoring over the personal area network for advertisements, a second step of receiving over the personal area network the periodic advertisements from the keybox, a third step of determining whether the periodic advertisements are indicative of the key being within the keybox or removed from the keybox; wherein when the periodic advertisements are indicative of the key being within the keybox, the mobile-device is configured to return to the first step, and when the periodic advertisements are indicative of the key being removed the keybox, the mobile-device is configured to perform steps comprising: a fourth step of monitoring elapsed time against a predetermined time period, a fifth step of monitoring a distance from the keybox against a predetermined distance, a sixth step of continuing to monitor for transmitted periodic advertisements over the personal area network from the keybox and determining whether the periodic advertisements are indicative of the key being within the keybox or removed from the keybox, wherein when the periodic advertisements are indicative of the key being within the keybox, the mobile-device is configured to discontinue monitoring elapsed time and monitoring the distance to the keybox and to return to the first step, and when either of the elapsed time becomes greater than the predetermined time period or the distance from the keybox becomes greater than the predetermined distance the mobile-device is configured to provide an alert.

In addition to one or more of the above features and steps, or as an alternative, following providing the alert, the mobile-device is configured to: monitor for transmitted periodic advertisements over the personal area network from the keybox and determine whether the periodic advertisements are indicative of the key being within the keybox or removed from the keybox, wherein when the periodic advertisements are indicative of the key being within the keybox, discontinuing the alert and returning to the first step.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
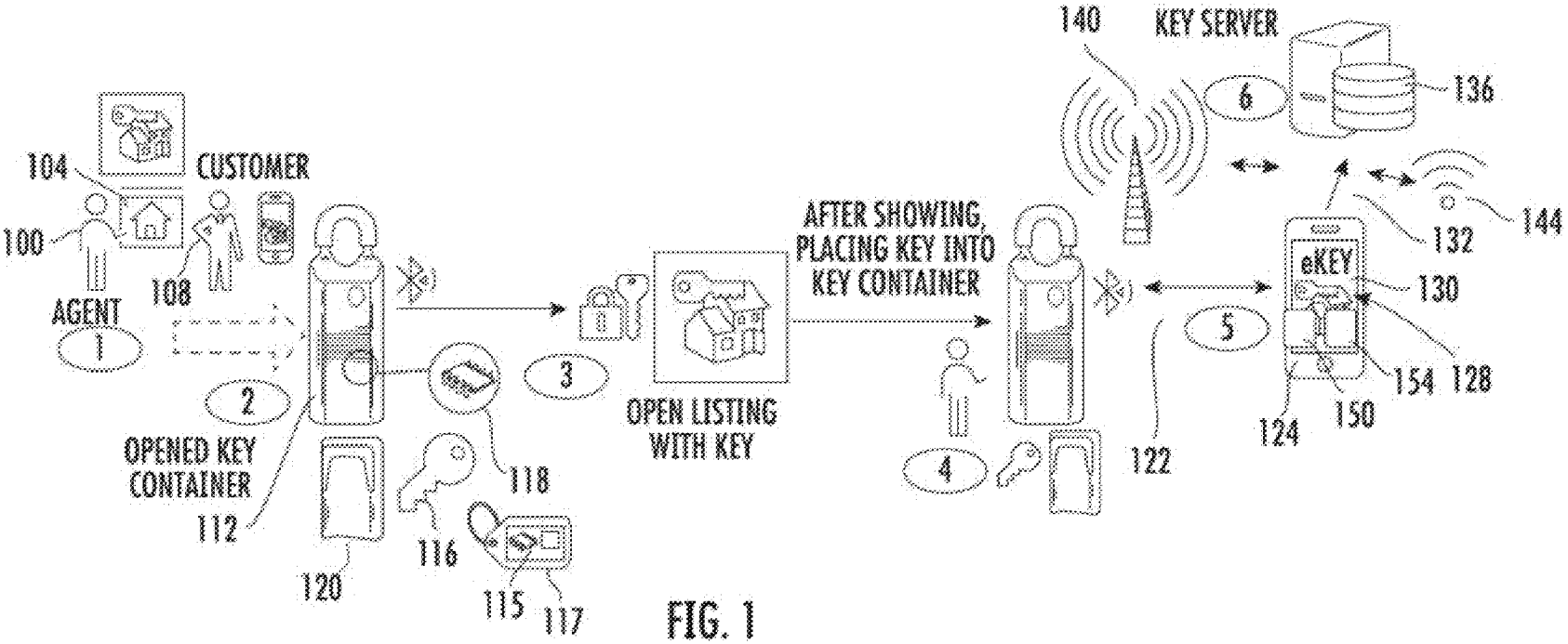
FIG. 1 illustrates features of an embodiment of the disclosure.
Figure 2:
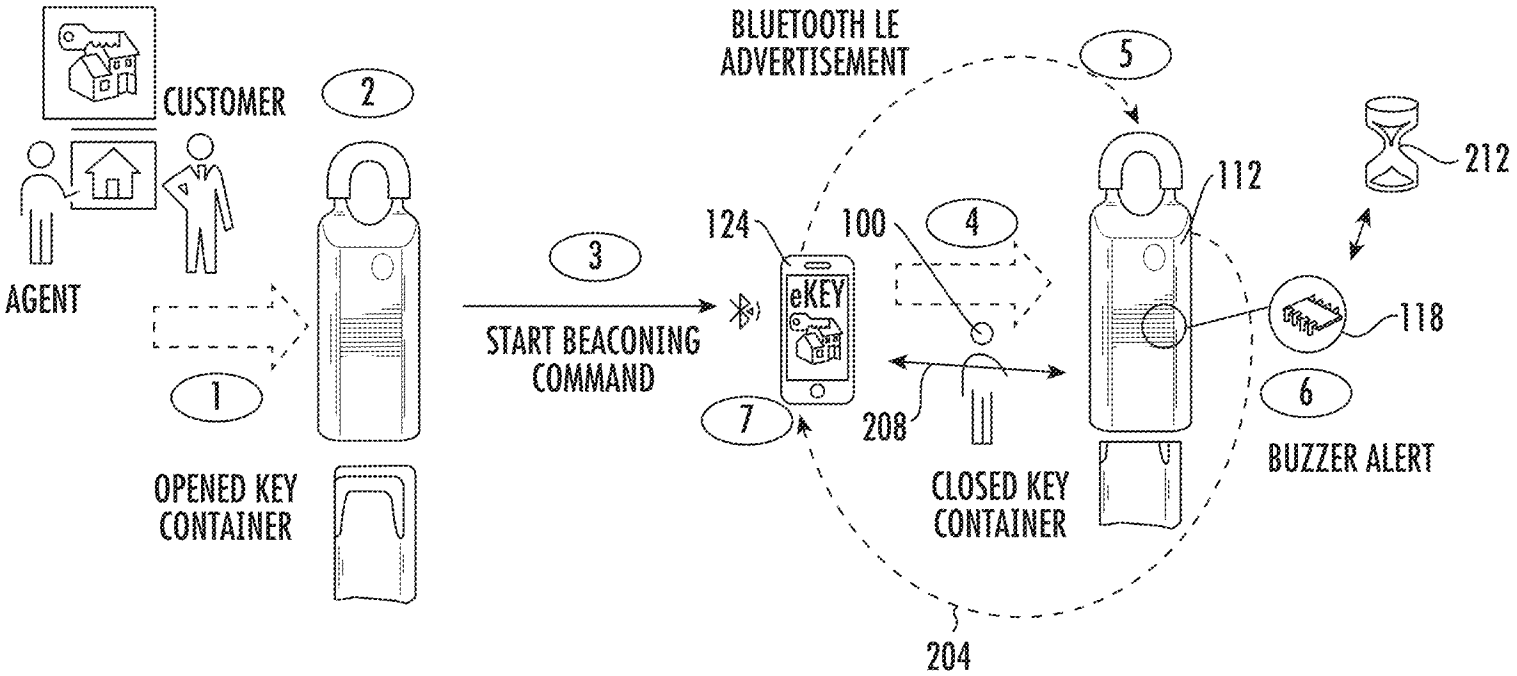
FIG. 2 illustrates features of an embodiment of the disclosure.

FIGS. 1 and 2 illustrate environments in which the disclosed embodiments may be practiced. A user in the embodiments may be real estate agent 100 who may intend to access an available property 104 to display to a customer, that is, a potential buyer 108. A keybox 112 may be disposed proximate the property in which an access key 116 is maintained. The keybox may include an electronic controller 118 to control electro-mechanical functions of the keybox and to provide the keybox with telecommunication capabilities. Access to the key may be through a key container 120 in the keybox. The key container may be capable of being secured in an opened state by electro-mechanical control from the controller, during which time a key 116 may be removed and replaced in the keybox. In a locked or closed state the key 116 in the key container 120 may be locked within the keybox 112.

The keybox may be a first smart device that may communicate over a personal area network (PAN) 122 with a mobile-device 124, which may be a mobile phone that may be a second smart device and which may be in possession of the agent 100. PAN protocols may include, for example, NFC (near field communication), BlueTooth Low Energy (BLTE) or ZIGBEE. The mobile-device 124 may be equipped with an App 128, available from an App Store, providing program level communications between the keybox 112 and the mobile-device 124. The agent 100 may interact with the App 128 via a screen 130 on the mobile-device 124. In addition, using the APP 128, the mobile-device 124 may communicate over the Internet 132 with a central server 136. Moreover, the mobile-device may use a cellular network 140 for access to the Internet or the mobile-device may access the Internet by, for example, a connection over Wi-Fi 144 (trademark of the Wi-Fi Alliance).

Figure 3:
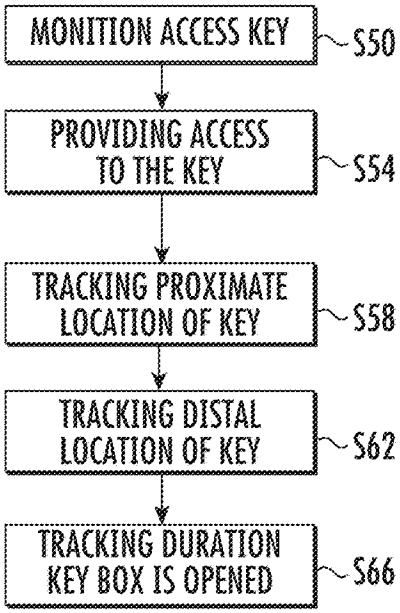
FIG. 3 illustrates a process according to embodiment of the disclosure.

Referring to FIG. 3, at step S50 the controller 118 may monitor a location of the access key 116. Under this step, the controller may perform a first step S54 of providing access to the key 116 within the keybox 112 while the keybox 112 is in the locked configuration, which is illustrated in greater detail in FIGS. 1 and 4. The controller may also perform a second step S58 of tracking a proximate, or near field, location of the key 116 to determine if the key is being returned to the keybox 112 by the agent, which is discussed in greater detail in FIGS. 1 and 5. The controller may also perform a third step S62 of tracking a distal, or far field, location of the key 116 relative to the keybox to prevent the agent 100 from potentially leaving with the key, which is illustrated in greater detail in FIGS. 2 and 6. The controller may also perform a fourth step S66 of tracking a duration the keybox is opened to identify if the key 116 is potentially lost by the agent, which is illustrated in greater detail in FIGS. 2 and 7.

Figure 4:
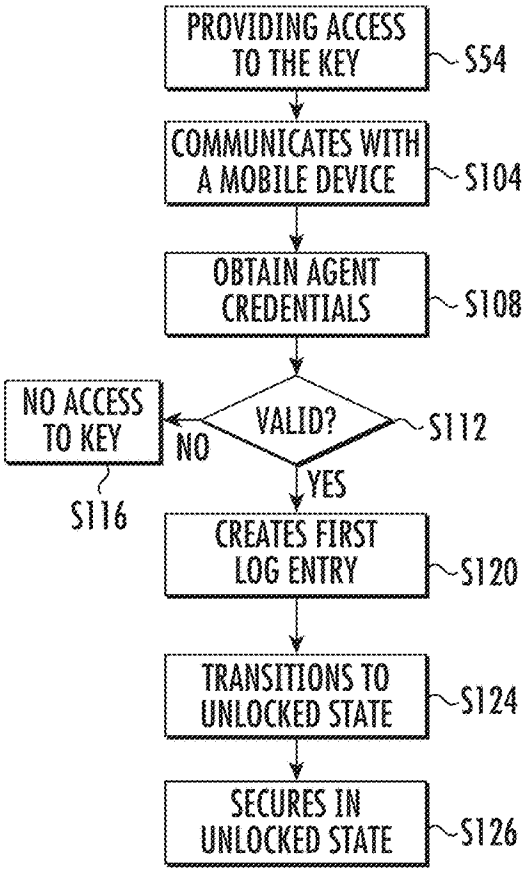
FIG. 4 illustrates a process according to an embodiment of the disclosure.

Referring to FIGS. 1 and 4, as indicated, at step S54 the controller may execute the first step of providing access to the key 116 within the keybox 112 while the keybox 112 is in the locked configuration. Initially the key 116 may be in the keybox 112, the keybox 112 may be in a closed state. At step S104 the keybox controller 118 may communicate with the mobile-device 124 of the agent (using the App 128) when the agent seeks to obtain the access key 116. These communications occur, for example, using BTLE. At step S108 the controller 118 may obtain credentials from the mobile-device 124 which may represent the agent 100 credentials for accessing the key.

At step S112 the controller 118 may determine whether the credentials are valid. If the credentials are not valid then at step S116 the controller may not grant access to the key 116 by, for example, not unlocking the keybox 112. If the credentials are valid then at step S120 the controller 118 may record a first audit log entry in an audit log stored on the controller 118, where the first entry may include the credentials or at least an identifier of the agent 100 and may indicate that access to the key 116 is being provided. At step S124 the controller 118 using electromechanical controls may configure the keybox 112 to the unlocked or opened state to provide access to the key container 120 and hence the key 116. At step S126 the controller may secure the keybox in the unlocked state.

Figure 5:
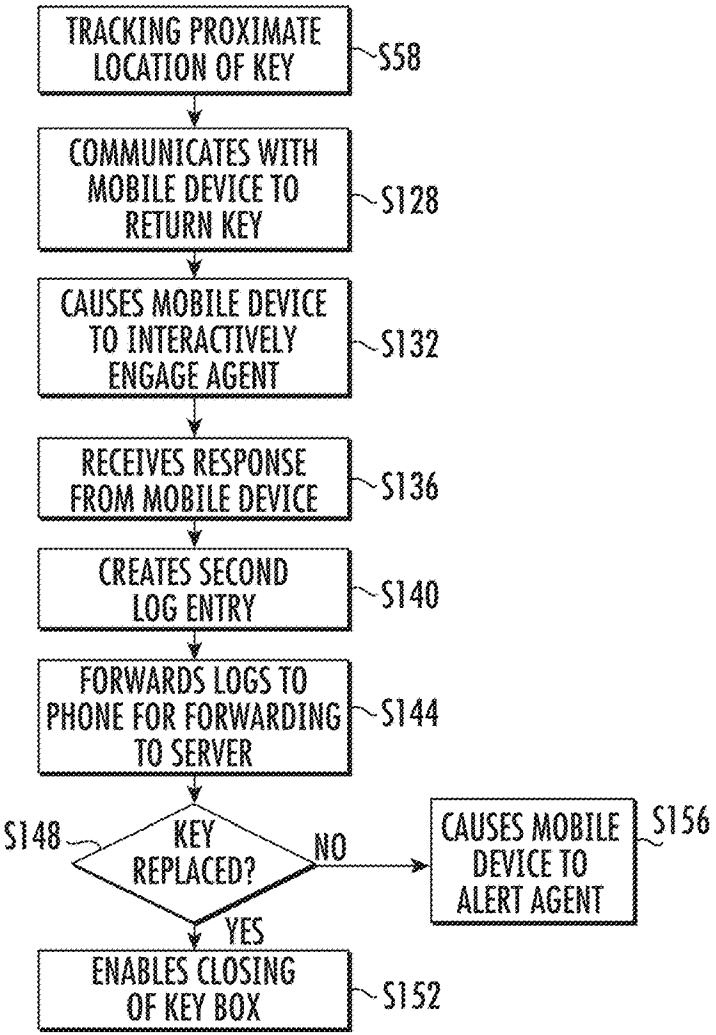
FIG. 5 illustrates a process according to an embodiment of the disclosure.

Referring to FIGS. 1 and 5, as indicated, at step S58 the controller may execute the second step of tracking a proximate, or near field, location of the key 116 to determine if the key is being returned to the keybox 112 by the agent 100. After showing the property to the customer 108, at step S128 the controller 118 may again communicate with the mobile-device 124 of the agent 100 as the agent attempts to return or replace the key 116. At step S132 the controller may instruct the mobile-device 124 to interactively engage the agent to determine whether the key 116 has been replaced in the keybox. For example the mobile-device may provide a visual query on the screen 130, responsive to which the mobile-device may receive a "YES" or "NO" using respective first and second radio buttons 150, 154.

At step S136 the controller 118 may receive data from the mobile-device 124 indicative of the response from the agent 100. At step S140 the controller 118 may record a second audit log entry indicator of the response of the agent 100. At step S144 the controller may transfer the audit log data to the mobile-device 124, which may transfer the audit data to the central server 136. The audit data may serve as a digital check to ensure that the agent 100 left the key 116 in the keybox. At step S148 the controller may determine whether the response from the agent indicated that the key 116 was being replaced in the box.

If the response was "YES" then at step S152 the controller may enable closing of the keybox by the agent, for example, by releasing the keybox from the unlocked state and allowing the key container 120 to latch into the keybox 112. If the response was "NO" then at step S156 the controller may again communicate with the mobile-device and cause the mobile-device to interactively engage the agent with an alert indicating that the key must be replaced.

On one embodiment, in addition to or instead of asking the agent at step S132 and S136 whether the key is being returned, the keybox 112 may directly detect whether the key 116 is being returned. For example, the key 116 could have a Bluetooth chip 115 on a key ring 117 (FIG. 1) that advertises periodically. Based on proximity, for example, whether the key 116 is inside the keybox 112, outside the keybox 112 but close in proximity to the keybox 112, or relatively far away from the keybox 112, the keybox 112 may determine whether and which key 116 is in the keybox 112. If other keys have similar technology implements, the keybox 112 could determine when a key belonging in another keybox is accidently placed in the keybox 112. When a key belonging in a different keybox is placed in the keybox 112, an alert may be sent to the agent which requests that the agent confirm the correct keys are being positioned in the keybox.

Alternatively, the key 116 could have a radio frequency identification (RFID) chip that may be on the same board as the Bluetooth chip 115 and that may be read by an RFID reader upon insertion of the key 116 into the keybox 112. The RFID reader may be part of the controller 118 within the keybox 112. Yet alternatively the key could have a chemical signature, a visual identifier (barcode, QR code, etc. that is scanned by the box when it is returned). Moreover, the sensor in the keybox could be a mechanical tamper spring, or a magnetic sensor such as a magnetic reed proximity switch. In one embodiment the presence or absence of the key container 120 can be determined by the keybox 112 to determine if the key 116 is present or absent respectively.

In one embodiment the keybox 112 determines at any time from one or more above disclosed features and/or steps that the key 116 has been returned. In such an instance, procedures disclosed herein which may subsequently create an alert may be aborted. This may avoid the controller 118 or mobile-device 124 from creating undue alerts.

Figure 6:
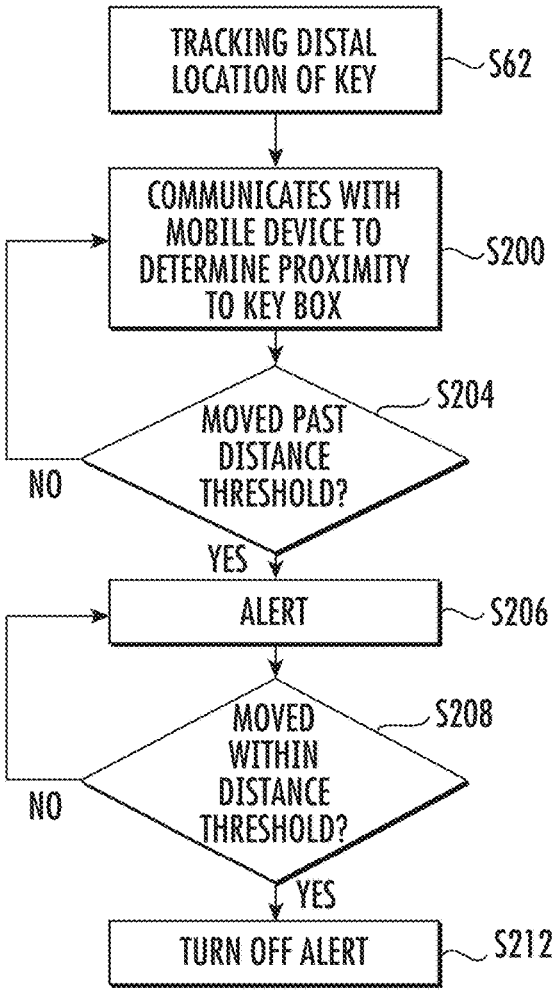
FIGS. 6 and 6A illustrate a process according to an embodiment of the disclosure.

Turning to FIGS. 1, 3 and 6, and as indicated, at step S62 the controller may execute a third step of tracking a distal, or far field, location of the key 116 relative to the keybox 112 to prevent the agent from potentially leaving with the key. At step S200 the controller 118 may periodically communicate 204 (FIG. 2) with the mobile-device 124 to determine a proximity 208 of the mobile-device to the keybox. At step S204 the controller may determine whether the mobile-device has moved beyond a predetermined distance threshold while the keybox is in the opened state. While the determination at step S204 is "NO" the controller may keep monitoring proximity to the mobile-device. If the determination is "YES" at step S204, then at step S206 the controller may cause the mobile-device to interactively communicate with the agent. This interaction may be in the form of an alert which may be a visual, audible and/or vibratory alert. The controller may then perform step S208 of determining whether the mobile-device has returned to a position that is within the threshold distance. So long as the determination at S208 is "NO" the alert may stay active on the mobile-device of the agent. If the determination is "YES" then at step S212 the controller may cause the mobile-device to turn off the alert.

In one embodiment, the key 116 may be equipped with BTLE communication implements 115 as indicated above. In addition to or as an alternate to the features and steps performed in FIG. 6, tracking of proximity of the key 116 may be performed by communications between the keybox 112 and the key 116. Such tracking may be based on periodic BTLE advertisements from the key 116. The lock controller 118 may track the distance to the key 116 as compared with tracking the distance to the mobile-device 124. Alternatively, the mobile-device 124 may determine when it is proximate the key 116 using periodic BTLE advertisements from the key 116. If the key 116 is not in the keybox 112 and the key 116 is not proximate the mobile-device 124, the mobile-device 124, may be disposed to provide the agent with an alert to indicate that the key 116 has been left in an unsecure location. A determination to provide the alert, in this embodiment and in each embodiment provided herein, may be based on instructions from the controller or may be automatically created based on protocols in the App 128 on the mobile-device.

Figure 6A:
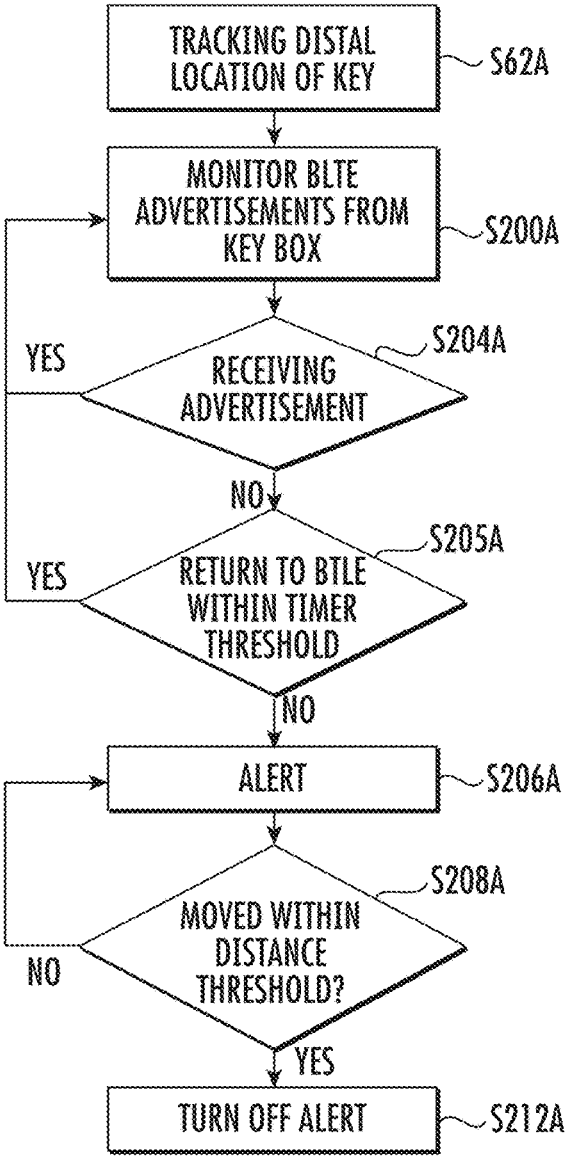

In one embodiment illustrated in FIG. 6A, in addition to or as an alternative of the features and steps disclosed under step S62 in FIG. 6, the mobile-device 124 may perform step S62A in FIG. 6A to determine whether the key 116 is accidentally being removed from the property by the agent 100. At step S200A the mobile-device 124 may listen to a BLTE advertisements from the keybox BTLE transceiver 118 so that the mobile-device may determine a distance to the keybox 112. As long as the mobile-device 124 is within a predetermined range of the keybox 112, and the mobile-device 124 receives the BTLE advertisement from the keybox 112, and the determination is "yes" at step S204A. As a result, no alert may be created by the mobile-device 124.

When the agent with the mobile-device 124 moves outside the range, the determination is "no" at step S204A. At step S205A, a timer may be triggered on the mobile-device 124 for allowing the agent to return within range. When the timer elapses, or if the agent leaves a geofence range around the keybox 112 or property 104, at step S206A the mobile-device 124 may remind the agent with an alert to return to the keybox 112 and return the key 116. If the keybox 112 advertisement indicates the key 116 has been returned or if the agent returns to the threshold zone at step S208A, then the mobile-device 124 may abort this reminder procedure at step S212A.

It is to be appreciated that in such embodiment the APP 128 on the mobile-device 124 may autonomously monitor a distance from itself to the keybox 112. In addition, then the mobile-device 124 may autonomously alert the agent if the agent has been out of range for too long or if the mobile-device 124 has moved too far away. That is, the mobile-device 124 may not need instructions from the keybox 112 in order to create an alert for the agent.

Figure 7:
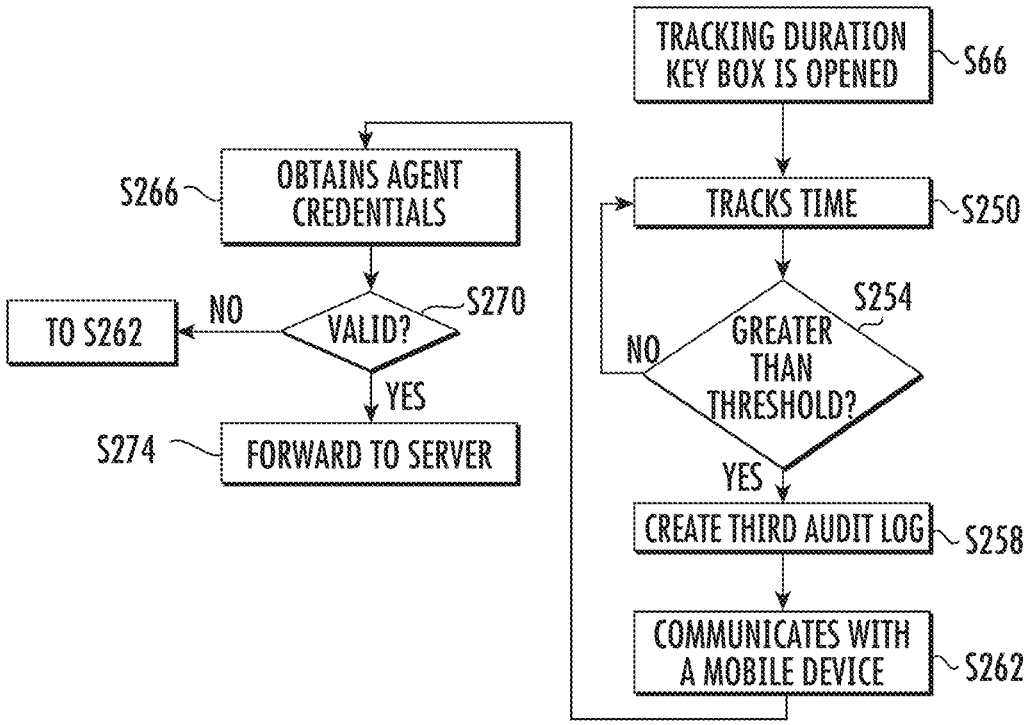
FIG. 7 illustrates a process according to an embodiment of the disclosure.

Referring to FIGS. 2 and 7, as indicated, at step S66 the controller may execute a fourth step of tracking a duration the keybox is opened to identify if the key is potentially lost by the agent. At step S250 the controller may monitor the duration of time, illustrated schematically as an hour glass 212, that the keybox has been in the opened state. At step S254 the controller may determine whether the duration is greater than a predetermined threshold. While the determination is "NO" at step S254, the controller may continue to track the duration of time the keybox is opened. If the determination becomes "YES" then at step S258 the controller may record a third audit log entry indicating that the keybox has been opened for a duration that is greater than the predetermined threshold, indicating the key may be lost by the agent.

At step S262 the controller may communicate with a second mobile-device for a second agent seeking to obtain the key from the keybox. At step S266 the controller may obtain second credentials from the second agent and at step S270 the controller may determine whether the second credentials are valid. If the determination is "YES" then at step S274 the controller may transfer the audit log to the second mobile-device for transferring to the audit log to the central server. If the determination is "NO" then the controller may wait to communicate with another mobile-device for another agent and cycle back to step S262.

The above disclosed embodiments may prompt the agent with a message such as an alert to determine whether a key is inside a keybox before the keybox is closed as the agent leaves the property. The disclosed embodiments may electronically transmit a message, an auditory, vibratory or other typical alert to the agent via the mobile-device for the agent, indicating whether the key is in the keybox. The disclosed embodiments may ensure that the key is replaced in the keybox. In addition, creation of the audit logs may enable tracking of the location of the key and who last used the key.

Figure 8:
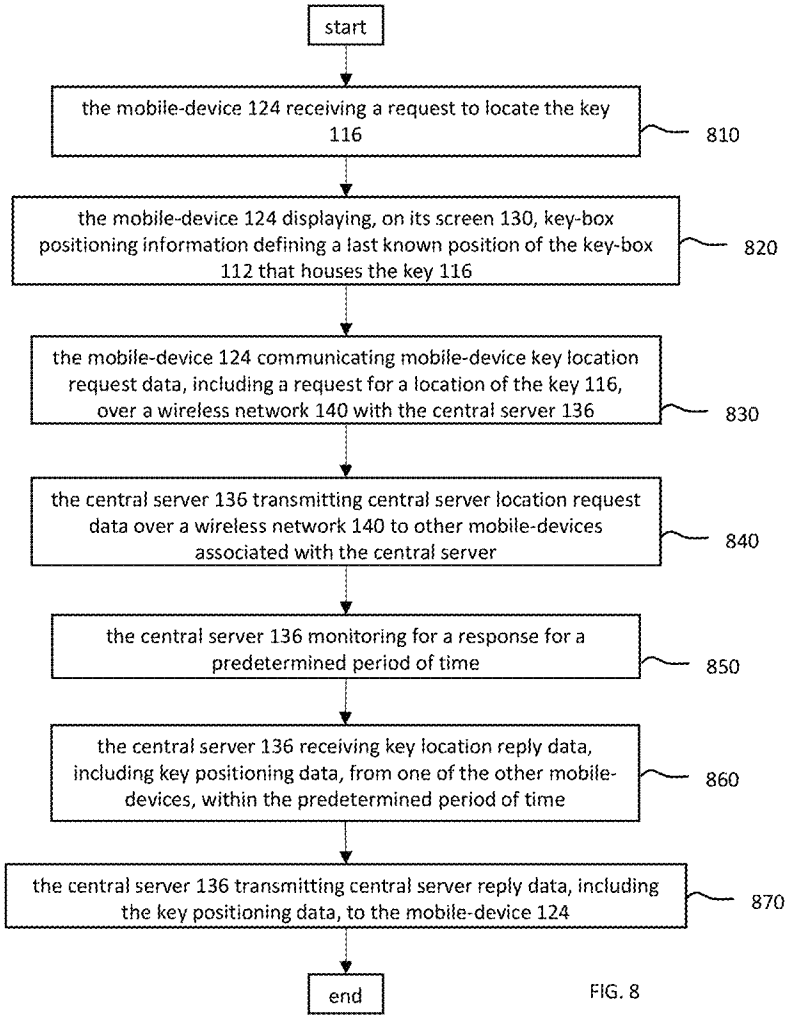
FIG. 8 is a block diagram showing a method of finding a key with a mobile-device according to an embodiment.

In addition to the above, FIG. 8 shows a block diagram illustrating a method of finding the key 116, by the agent 100, with the mobile-device 124. As shown in block 810, the method includes the mobile-device 124 receiving a request to locate the key 116.

The request may come from the agent 100 directly engaging the App 128 via the mobile-device 124. The agent 100 may only know the identity of the key 116 by inference: the key 116 is attached to a processor or chip 115 in a tag 117 that has a unique identifier (id) that is associated with a street address, an agent, and a keybox 112, for example. The request can specify the street address, for example, and by inference there can be a determination as to which key 116 is being requested also potentially which keybox 112 it is associated with/inside of, and what property/real estate listing this key 116 is for example.

As shown in block 820, the method includes the mobile-device 124 displaying, on its screen 130, keybox positioning information defining a last known position (e.g., GPS coordinates) of the key 116 or its keybox 112 That is, the last known position may be of the key 116 or the keybox 112 as both the key and the keybox are advertising a Bluetooth signal as indicated above. The key 116 and keybox 112 can be tracked independently of each other, though in association with each other. For example, if it is known that the key 116 is in the keybox 112, and if a location of the keybox 112 is known, then the location of the key 116 may be inferred. Alternatively, the key 116 and keybox 112 can be tracked separately. For example, if the last known location of the key 116 is known as determined by another mobile-device (using that other mobile-device's GPS at the same time that the other mobile-device received the last Bluetooth signal from the chip attached to the key 116), this last known location could be communicated to the mobile device 124 from the other mobile device or from the central server 136 prior to the request in step 810 or even as part of step 820 to display the last known position.

As shown in block 830, the method includes the mobile-device 124 communicating mobile-device key location request data, including a request for a location of the key 116, over a wireless network 140 with the central server 136. Other networks identified herein may be utilize for this communication.

For example, the mobile app is being used by a Real Estate agent. In the app is a list of listings (homes for sale) that the agent is managing. For each listing there is a keybox 112 and a housekey 116. The agent can select the key 116, or the keybox 112, via the mobile app and ask 'where is it'. The app may have a location already based on the agent's own activity (i.e. the agent was recently near a keybox 112 or key 116). This location can be displayed, e.g. by indicating the key 116 and/or keybox 112 was at an identified location at an identified date/time.

The agent can select an option to ask the server (step 830) to identify who else has seen the key 116. The server can respond with any known location data from others. The agent can see data that identifies the last date/time that others were able to locate the key. The agent can then select to request to find the key at that time, e.g., dynamically. This is a request to the server that is transmitted to all the other agents' mobile-devices to search for the key 116. If the key 116 is found by any one of the respective other mobile-devices, a signal is returned to the server 136 by that other mobile-device, identifying that the specific key 116 is found.

The server then sends a message back to the requesting agent's mobile-device 124, e.g., indicating that the key 116 is found at that time by another agent, via the other agent's mobile-device. Otherwise, after waiting a predetermined period of time, the server transmits to the agent's mobile-device 124 that the location of the key 116 is not yet known.

Thus, as shown in block 840, the method includes the central server 136 transmitting central server location request data over a wireless network 140 to the mobile-devices operationally associated with it, e.g., due to having the app uploaded to it. Any of the networks identified herein may be used for this communication. The mobile-devices will scan for Bluetooth advertisements from the key 116. If the mobile-devices find keys, then they respond back to the server with their current location and the specific keys they respectively identified.

As shown in block 850, the method includes the central server 136 monitoring for a response from the mobile devices for a predetermined period of time. That is, the central server 136 is monitoring for responses coming back from the mobile-devices with information about the specific keys they have individually found. In one embodiment, the predetermined period of time is 5 minutes.

As shown in block 860, the method includes the central server 136 receiving key location reply data, including key positioning data, from the mobile-device, within the predetermined period of time. In one embodiment the key positioning data is global positioning data.

As shown in block 870, the method includes the central server 136 transmitting central server reply data, including the key positioning data, to the mobile-device 124. In one embodiment, the central server reply data includes a map link to find the key 116. Alternatively, the mobile-device 124 displays a map that includes the location of the key 116 based on the data returned from the central server 136.

With the above embodiments, an agent is looking for potentially misplaced housekeys used during, e.g., multiple showings of a property, would be able to locate the housekeys by means of the mobile APP 128.

Figure 9:
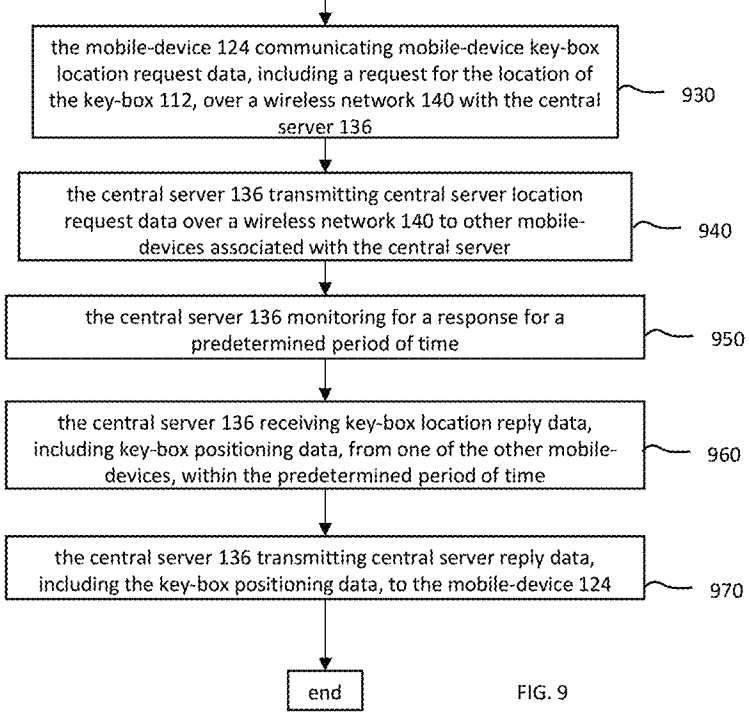
FIG. 9 is a block diagram showing a method of method of finding a keybox with a mobile-device according to an embodiment.

In addition to the above, FIG. 9 shows a block diagram illustrating a method of finding the keybox 112 that houses the key 116, by the agent 100, with the mobile-device 124. As shown in block 910, the method includes the mobile-device 124 receiving a request to locate the keybox 112.

The request may come from the agent 100 directly engaging the App 128 via the mobile-device 124. The agent 100 may only know the identity of the keybox 112 by inference: the key 116, normally stored in the keybox 112, is attached to a processor or chip 115 in a tag 117 that has a unique identifier (id) that is associated with a street address, an agent, and the keybox 112, for example. The request can specify the street address, for example, and by inference there can be a determination as to which keybox 112 is being requested also potentially which key 116 it is associated with/carrying, and what property/real estate listing this keybox 112 is for, example.

As shown in block 920, the method includes the mobile-device 124 displaying, on its screen 130, keybox positioning information defining a last known position (e.g., GPS coordinates) of the keybox 112 that houses the key 116, or the key 116. That is, the last known position may be of the key 116 or the keybox 112 as both the key and the keybox are advertising a Bluetooth signal as indicated above. The key 116 and keybox 112 can be tracked independently of each other, though in association with each other. For example, if it is known that the key 116 is in the keybox 112, and if a location of the key 116 is known, then the location of the keybox 112 may be inferred. Alternatively, the key 116 and keybox 112 can be tracked separately. For example, if the last known location of the keybox 112 is known, as determined by another mobile-device (using that other mobile-device's GPS at the same time that the other mobile-device received the last Bluetooth signal from the key 112), this last known location could be communicated to the mobile device 124 from the other mobile device or from the central server 136 prior to the request in step 810 or even as part of step 820 to display the last known position.

As shown in block 930, the method includes the mobile-device 124 communicating mobile-device keybox location request data, including a request for the location of the keybox 112, over a wireless network 140 with the central server 136. Any of the networks identified herein may be utilize for this communication.

For example, the mobile app is being used by a Real Estate agent. In the app is a list of listings (homes for sale) that the agent is managing. For each listing there is a keybox 112 and a housekey 116. The agent can select the key 116, or the keybox 112, via the mobile app and ask 'where is it'. The app may have a location already based on the agent's own activity (i.e. the agent was recently near a keybox 112 or key 116). This location can be displayed, e.g. by indicating the key 116 and/or keybox 112 was at an identified location at an identified date/time.

The agent can select an option to ask the server (step 930) to identify who else has seen the keybox 112. The server can respond with any known location data from others. The agent can see data that identifies the last date/time that others were able to locate the keybox 112. The agent can then select to request to find the keybox 112 at that time, e.g., dynamically. This is a request to the server that is transmitted to all the other agents' mobile-devices to search for the keybox 112. If the keybox 112 is found by any of the respective other mobile-devices, a signal is returned to the server from that other mobile-device, identifying that the specific keybox 112 is found. The server then sends a message back to the requesting agent's mobile-device, e.g., indicating that the keybox 112 is found at that time by another agent, via the other agent's mobile-device. Otherwise, after waiting a predetermined period of time, the server transmits to the agent's mobile-device that the location of the keybox 112 is not yet known.

Thus, as shown in block 940, the method includes the central server 136 transmitting central server location request data over a wireless network 140 to the mobile-devices associated with it, e.g., due to having the app uploaded to it. The mobile-devices will scan for Bluetooth advertisements from the keybox 112. If the mobile-devices find keyboxes, then they respond back to the server with their current location and the specific keyboxes they respectively identified.

As shown in block 950, the method includes the central server 136 monitoring for a response from the mobile devices for a predetermined period of time. In one embodiment, the predetermined period of time is 5 minutes. That is, the central server 136 is monitoring for responses coming back from the mobile-devices with information about the specific keyboxes they have individually found.

As shown in block 960, the method includes the central server 136 receiving keybox location reply data, including keybox positioning data, from the mobile-devices, within the predetermined period of time. In one embodiment the keybox positioning data is global positioning data.

As shown in block 970, the method includes the central server 136 transmitting central server reply data, including the keybox positioning data, to the mobile-device 124. In one embodiment, the central server reply data includes a map link to find the keybox 112. Alternatively, the mobile-device 124 displays a map that includes the location of the keybox 112 based on the data returned from the central server 136.

With the above embodiments, an agent is looking for potentially misplaced keybox 112 used during, e.g., multiple showings of a property, would be able to locate the keybox 112 by means of the mobile APP 128.

The term "about" is intended to include the degree of error associated with measurement of the particular quantity based upon the equipment available at the time of filing the application. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of determining a location of one of a key and a key box operationally coupled to each other, the method comprising:

the key, via a processor, and the key box, via a key box controller, periodically transmitting advertisements over a personal area network, wherein the key box advertisement is indicative of whether the key is in the key box, a mobile-device receiving a request to locate the one of the key and the key box from a user via an app installed on the mobile-device;

the mobile-device communicating mobile-device location request data, including a request for the location of the one of the key and the key box, over a wireless network with a central server;

the central server:

transmitting central server location request data over the wireless network to other mobile-devices operationally associated with the central server;

receiving from one of the other mobile-devices, data indicative that the one of the key and the key box is found and a position of the one of the key and the key box; and transmitting, to the mobile-device, positioning data, identifying the location of the one of the key and the key box;

the mobile-device receiving from the central server, the positioning data, identifying the location of the one of the key and the key box.

2. The method of claim 1, including:

the mobile-device displaying, on its screen, positioning information defining a last known position of the one of the key and the key box.

3. The method of claim 1, wherein the central server location request data includes a request for location information and identifying information of a plurality of the one of the keys and the key boxes respectively found by the other mobile devices, whereby the central server discriminates between received messages to locate the one of the key and the key box.

4. The method of claim 3, including the central server:

monitoring for a response for a predetermined period of time;

receiving location reply data, including the positioning data, for the one of the key and the key box from one of the other mobile-devices, within the predetermined period of time; and transmitting central server reply data, including the positioning data, to the mobile-device.

5. The method of claim 4, wherein:

the central server reply data includes a map link to find the one of the key and the key box; or the mobile device displays a map that includes the location of the one of the key and the key box based on the data returned from the central server.

6. The method of claim 1, wherein the mobile device performs steps comprising:

a first step of monitoring over the personal area network for the advertisements, a second step of receiving over the personal area network the periodic advertisements, a third step of determining whether the periodic advertisements are indicative of the key being within the key box or removed from the key box;

wherein when the periodic advertisements are indicative of the key being within the key box, the mobile device returns to the first step, and when the periodic advertisements are indicative of the key being removed the key box, the mobile device performs further steps comprising:

one of a fourth step and a fifth step, wherein:

the fourth step includes monitoring elapsed time against a predetermined time period and the mobile device provides an alert when the elapsed time becomes greater than the predetermined time period;

the fifth step includes monitoring a distance from the key or key box against a predetermined distance and the mobile device provides the alert when the distance becomes greater than the predetermined distance; and a sixth step of continuing to monitor for transmitted periodic advertisements over the personal area network from the key or key box and determining whether the periodic advertisements are indicative of the key being within the key box or removed from the key box, wherein when the periodic advertisements are indicative of the key being within the key box, the mobile device discontinues monitoring and to return to the first step.

7. A system for determining a location of a key, comprising a mobile-device in communication with a central server over a wireless network a key and a key box operationally coupled to each other, wherein the key, via a processor, and the key box, via a key box controller, are configured to periodically transmit advertisements over a personal area network, wherein the key box advertisement is indicative of whether the key is in the key box;

the mobile device is configured to:

receive a request to locate the one of the key and the key box from a user via an app installed on the mobile-device;

communicate mobile-device location request data, including a request for the location of the one of the key and the key box, over the wireless network with the central server; and the central server is configured to:

transmit central server location request data over the wireless network to other mobile-devices operationally associated with the central server;

receive from one of the other mobile-devices, data indicative that the one of the key and the key box is found and a position of the one of the key and the key box; and transmit, to the mobile-device, positioning data, identifying the location of the one of the key and the key box; and the mobile device is further configured to:

receive from the central server, positioning data, identifying the location of the one of the key and the key box.

8. The system of claim 7, wherein:

the mobile-device is configured to display, on its screen, positioning information defining a last known position of the one of the key and the keybox.

9. The system of claim 7, wherein the central server location request data includes a request for location information and identifying information of a plurality of the one of the key and the key box respectively found by the other mobile devices, whereby the central server discriminates between received messages to locate the one of the key and the key box.

10. The system of claim 9, wherein the central server is configured to:

monitor for a response for a predetermined period of time;

receive location reply data, including the positioning data, for the one of the key and the key box, from one of the other mobile-devices, within the predetermined period of time; and transmit central server reply data, including the positioning data, to the mobile-device.

11. The system of claim 10, wherein:

the central server reply data includes a map link to find the one of the key and the key box; or the mobile device displays a map that includes the location of the one of the key and the key box based on the data returned from the central server.

12. The system of claim 7, wherein the mobile device is configured to perform steps comprising:

a first step of monitoring over the personal area network for the advertisements, a second step of receiving over the personal area network the periodic advertisements, a third step of determining whether the periodic advertisements are indicative of the key being within the key box or removed from the key box;

wherein when the periodic advertisements are indicative of the key being within the key box, the mobile device is configured to return to the first step, and when the periodic advertisements are indicative of the key being removed the key box, the mobile device is configured to perform further steps comprising:

one of a fourth step and a fifth step, wherein:

the fourth step includes monitoring elapsed time against a predetermined time period and the mobile device is configured to provide an alert when the elapsed time becomes greater than the predetermined time period;

the fifth step includes monitoring a distance from the key or key box against a predetermined distance and the mobile device is configured to provide the alert when the distance becomes greater than the predetermined distance; and a sixth step of continuing to monitor for transmitted periodic advertisements over the personal area network from the key or key box and determining whether the periodic advertisements are indicative of the key being within the key box or removed from the key box, wherein when the periodic advertisements are indicative of the key being within the key box, the mobile device is configured to discontinue monitoring and to return to the first step.

* * * * *